United States Patent [19]

Barone

[11] Patent Number: 4,768,820

[45] Date of Patent: Sep. 6, 1988

[54] CABLE CATCH, CLAMP AND CUT (GRAPPLE)

[76] Inventor: Robert J. Barone, 4609 Greenway Ave., Wilmington, N.C. 28403

[21] Appl. No.: 806,596

[22] Filed: Dec. 9, 1985

[51] Int. Cl.[4] ..... B63G 07/20

[52] U.S. Cl. ..... 294/66.1

[58] Field of Search ..... 294/66.1, 99.1; 405/173

[56] References Cited

U.S. PATENT DOCUMENTS 3,129,030 4/1964 Brockbank et al. ..... 294/66.1

FOREIGN PATENT DOCUMENTS 971152 9/1964 United Kingdom ..... 294/66.1

1540724 2/1979 United Kingdom ..... 294/66.1

*Primary Examiner*—James B. Marbert

[57] ABSTRACT

A grapple of rugged construction capable of being towed along the ocean bed for recovery of underwater communication cables; having a scoop with suitable inserts to furrow and "scoop up" cable. Guided, cable is forced into a "floating" and "stationary" clamping assembly. Cable tension acts against a spring-loaded trigger releasing liquid/gas actuating a "wedge/block" via a gas cylinder and piston. The "wedge/block" driven between "floating clamps" having interchangeable inserts, firmly clamps the cable. A signal is transmitted. If the cable is to be uncut the CCC&C is hauled aboard tow vessel, cable intact. If desired to cut cable on a particular side of CCC&C before recovery, diagonally-opposed knives and liquid/gas cylinders are pre-set before submergence. Cutting is accomplished by release of liquid/gas to "hydraulic fluid/gas cylinders" with free-floating pistons. Gas pressure on floating pistons forces and displaces hydraulic fluid actuating pistons (within cylinders) of selected knife cylinders with attached cutting knives. The clamped cable is automatically cut as pre-set and a second signal transmitted. The "wedge cylinder" and four "knife cylinders" are water tight using shaft and external seals for double sealing. Once activated, internal pressure counteracts external, maintaining water-tight integrity. The CCC&C may be used with existing monitoring tension equipment and machinery aboard cable (tow) vessels now in operation.

1 Claim, 5 Drawing Sheets

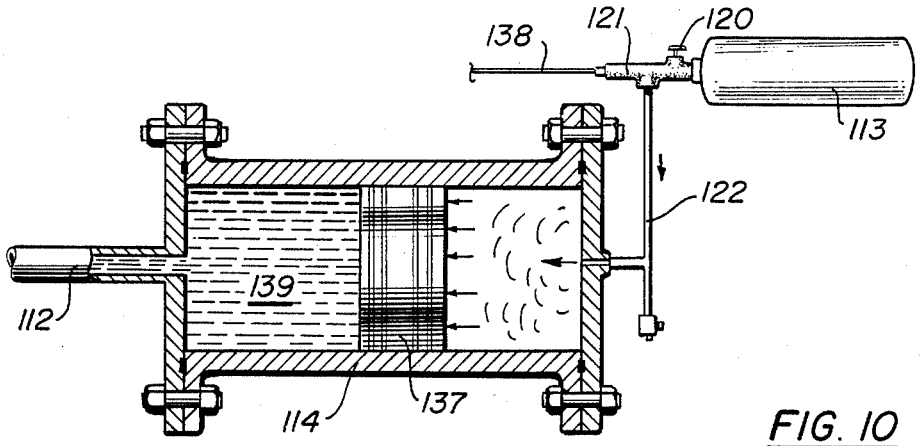
FIG. 10
FIG. 11
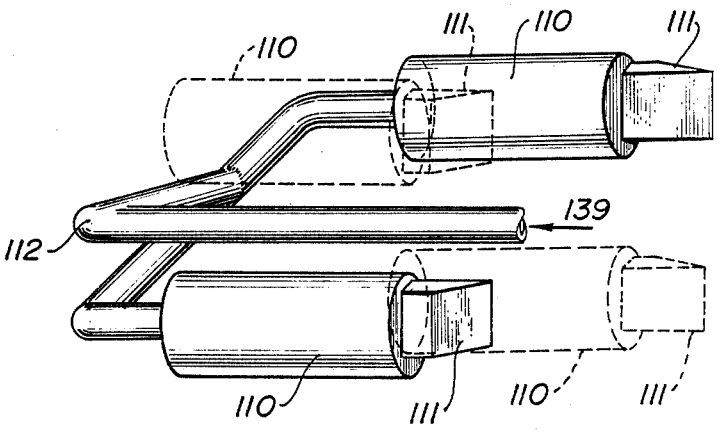
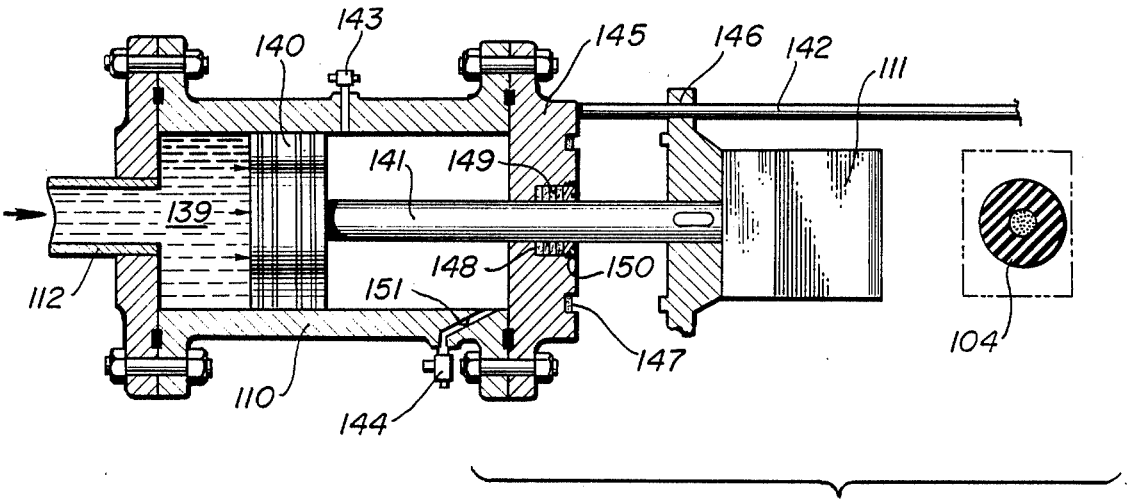
FIG. 12

CABLE CATCH, CLAMP AND CUT (GRAPPLE)

CROSS REFERENCE TO RELATED APPLICATIONS:

U.S. Patent Documents
Document No. 3,129,030, Date: 4, 1964
Name—Brockbank, et al, Class 294, Sub Class 66.1
Foreign Patent Documents
Document No. 1540724m Date: 2, 1979
Country, Great Britain
Name—Lardlow, Class 294, Sub Class 66.1
Document No. 971152, Date: 9, 1964
Country, Great Britain
Name—Brockbank, etal, Class 294, Sub Class 66.1

BACKGROUND OF THE INVENTION (1) Technical Field

This invention relates to grapples or grapnels for use in the recovery of submarine communication cables from the ocean floor. The grapple attached to a towing vessel by cable is dragged along the ocean bottom across a known path of a submarine cable in order to ensnare, raise the cable to the surface and aboard the towing vessel intact or in part, for purposes of repair and maintenance.

Tension registering apparatus presently in use aboard tow vessels indicate changes in tension pressure of the Cable Catch, Clamp and Cut (CCC&C) grapple under tow if and when the cable is ensnared. When a particular pressure is registered the tow vessel is stopped and maneuvered in such a way as to enable it to haul up the submarine cable intact or in part if the grapple is equipped with a cutting capability.

(2) Background Art

Very often after many failures at recovery with the resultant loss of time and expenditure, the more complex grapple (grapnels) presently in use have been set aside and it has been necessary to revert to the old hook drag type grapnel in order to retrieve the cable.

The advanced grapnels presently in use (Note: References) offer no variable penetration of their ploughshares (scoops) into the sea bottom. As a result the grapnel often passes over a buried cable or the reverse occurs where the fixed ploughshare digs unnecessarily into the ocean floor causing premature and misleading tension readings on the tow vessel resulting in a loss of time at the very least.

My grapple is designed to be dragged on and parallel to the ocean floor with little or no penetration on soft or rock hard bottoms. It does however incorporate an interchangeable penetration (insert) device at the nose of each scoop. A "scoop insert" can be used to provide zero penetration on rock hard bottoms to maximum penetration for sand, soft silt and muddy bottoms. Cable recovery even with a variety of ocean bottom conditions is made more highly probably with my invention.

Rocks or other debris often clog present grapnels preventing ensnarement of a cable when its path is crossed or they prematurely actuate the clamping and/or cutting mechanisms.

The scoops of my invention are so designed as to allow rocks to pass through with little change of anything else being guided up and into the clamping mechanism other than a submarine cable. Only a cable firmly and properly placed (guided by scoop design and the forward motion of the CCC&C) will actuate the clamping mechanism of my invention.

Time and effort is now lost as a result of misleading tension readings caused by grapples catching onto rocks or other submerged objects.

My invention immediately indicates by electronic/radio signal when a cable is securely held and clamped. It will also indicate by signal if and when the cable is cut. This combination of signal and/or signals in conjunction with tension readings on the tow vessel will more accurately reflect the grapnel's disposition on the ocean bottom and allow for proper maneuvering responses by the towing vessel.

Some grapples now in use only ensnare the cable and using its own (cable) weight and tension to cut it as it is raised toward the surface. It is then necessary to replace this with a different form of grapple, drag once again to relocate the cut cable, and snare and raise it to the surface.

With my invention the cable is caught and clamped. It may then be cut and the desired side brought to the surface.

Some grapples now in use after ensnaring, have caused distortion and serious damage to the cable. Often after the cable is ensnared and while it is being raised to the surface it breaks as a result of the distortion which has seriously weakened it, although it was meant to be recovered intact.

Often after a cable is ensnared and is meant to be cut and raised, the cutting device does not work because of clogging rocks or a distorted cable.

With my invention the cable is not damaged or distorted. Once clamped (electronically signalled) and without distortion it can be safely raised to the surface intact. If it is desired to cut one side of the cable (pre-set aboard the tow vessel) and raise the clamped side, there is little that can hinder the proper operation of the cutting mechanism.

All of the above problems were recently visibly observed by the writer aboard an ocean-going cable (tow) vessel. Often many hours, days and even weeks were wasted in futile efforts to ensnare one (cut or uncut) submarine communication cable using the very latest state-of-the art grapple devices.

SUMMARY

The object of the invention is the recovery of submerged communication cable resting at great depths on the ocean floor. The cable is caught, clamped and then can be cut on the desired side of the Cable Catch, Clamp and Cut (CCC&C) grapple and then brought to the surface.

Clamping and cutting are immediately responsive to tension as it is increased on the cable by movement of the towing vessel. Consequently there is no distortion of the cable or damage to the repeaters (electronic devices located at intervals on the cable).

BRIEF DESCRIPTION OF THE DRAWINGS

A more complete understanding of the invention may be had by reference to the accompanying drawings in which:

FIG. 10 is a sectional view taken on the line X—X of FIG. 4 and a liquid gas steel bottle.

FIG. 11 is a perspective and phantom view of the four diagonally opposed knife cylinders.

FIG. 12 is a sectional view taken on the line XII—XII of FIG. 4.

DETAILED DESCRIPTION

Figure 1:
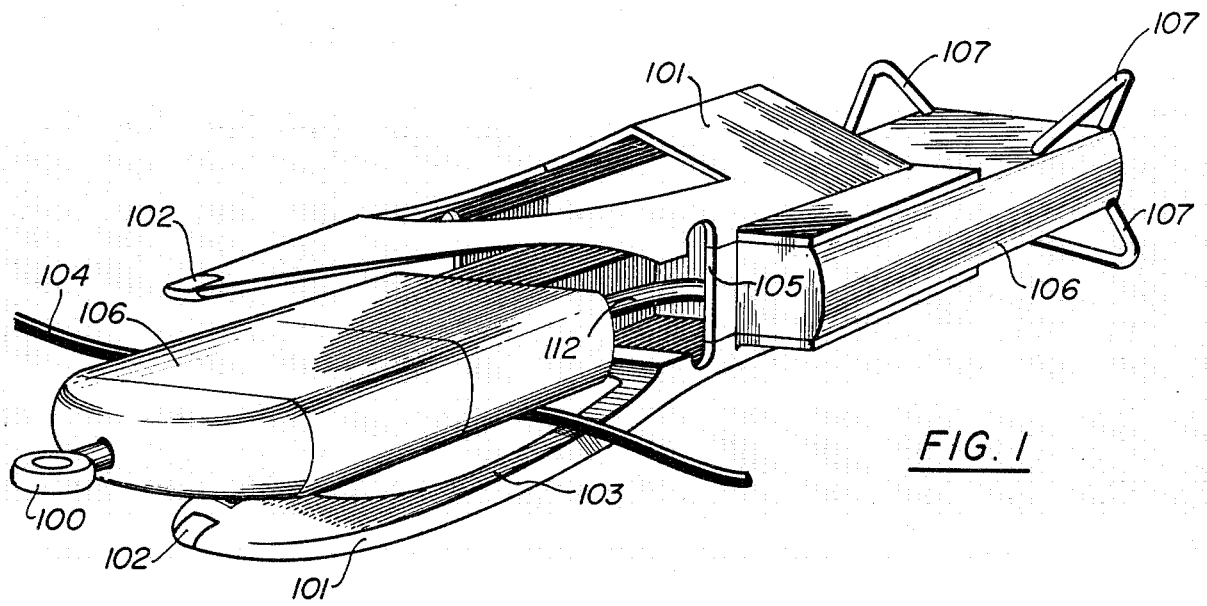
FIG. 1 is a perspective view of the invention.

The Cable Catch, Clamp and Cut (CCC&C) illustrated in FIG. 1 is designed to be towed by ship using a swivel eye bolt 100, dragged along the ocean floor to scoop 101 and a guide 103 and ensnare transoceanic communication cable for the purpose of retrieval, cut or uncut.

Figure 2:
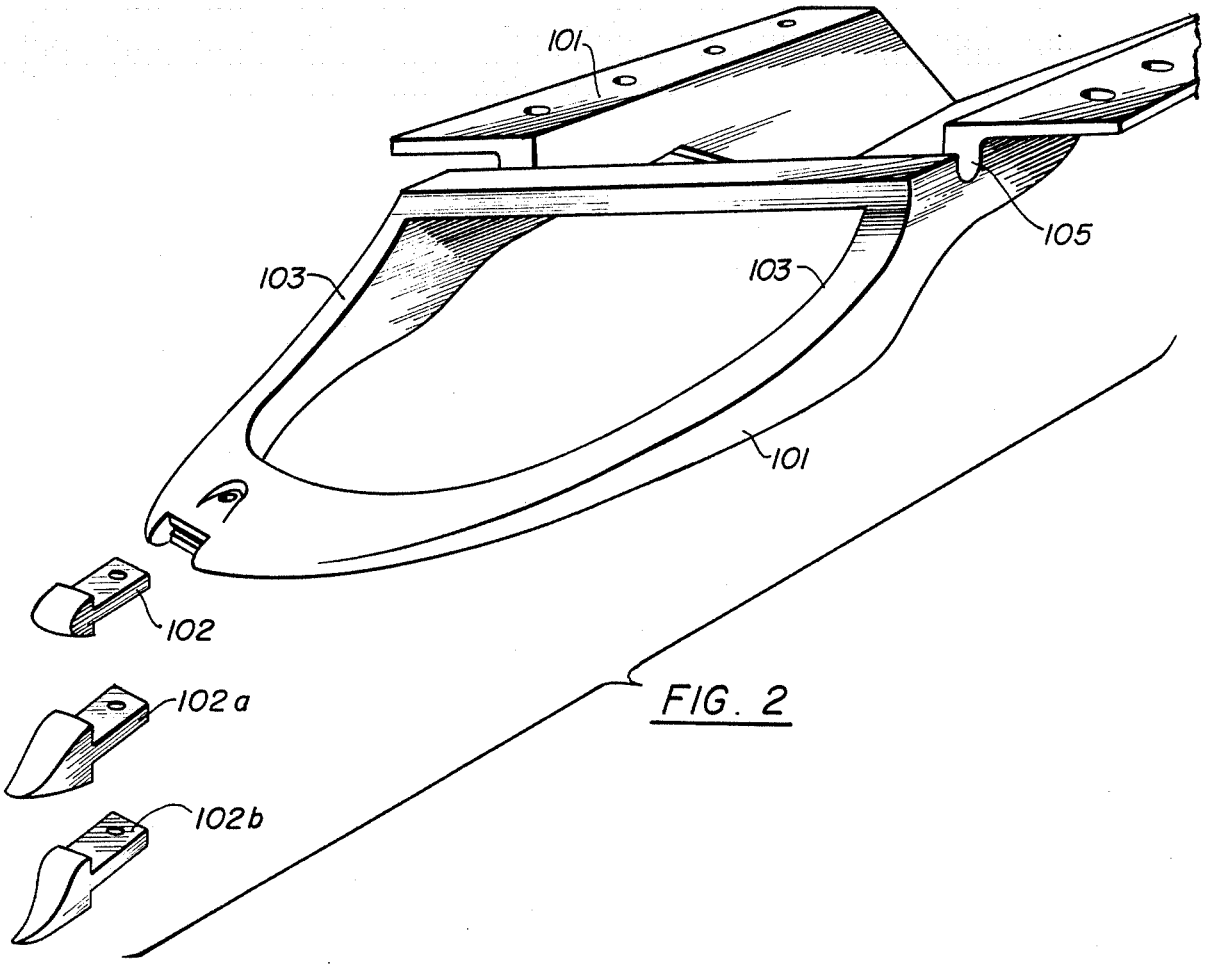
FIG. 2 is a perspective detail view of a scoop and scoop inserts.

A scoop insert 102 at the nose of the scoop 101 is interchangeable with scoop insert **102*a* and scoop insert 102*b*** as shown in FIG. 2. These provide a variety of depth penetrations into the ocean bottom.

The CCC&C is double sided so that it will operate satisfactorily however it lies on the ocean floor. The scoops 101 are designed to allow rocks, shells, soil and other debris to pass through without clogging any moving parts. They are made of high tensile steel and removable as are the covers 106. Steady fins 107 at the rear assist to maintain stability as the CCC&C is towed on the ocean floor.

A cable 104 after being scooped 101 is guided 103 up and into the cable stop 105.

Figure 3:
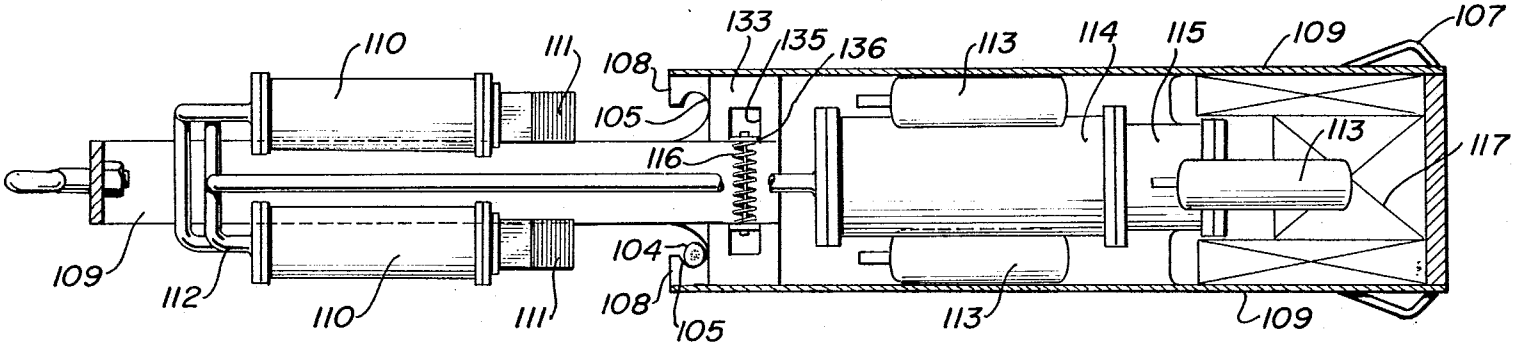
FIG. 3 is a side view of the invention with external covers removed.

In FIG. 3 the CCC&C is seen from the side with scoops 101 and all covers 106 removed. The cable 104 is now shown forced into a stationary clamp 108.

The chassis 109 supports internally and externally four (4) hydraulic knife cylinders 110 with cable cutting knives 111, hydraulic lines 112, liquid gas steel bottles 113, hydraulic oil/gas cylinders 114, wedge/block gas cylinder 115, floating clamp springs 116 and electronic battery pack 117.

Figure 4:
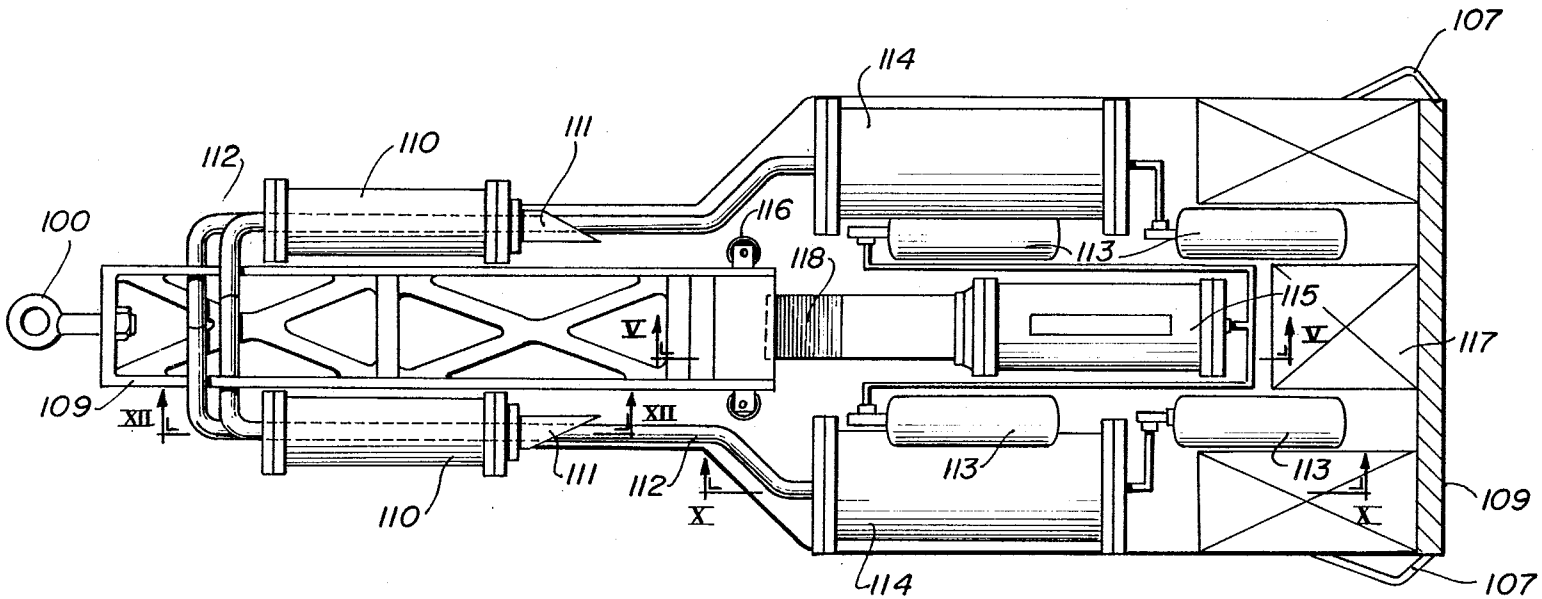
FIG. 4 is a top view of the invention with external covers removed.

In FIG. 4 and CCC&C is shown viewed from above with all attachments as described for FIG. 3. The wedge/block 118 and its gas cylinder 115 are viewed more fully.

Figure 5:
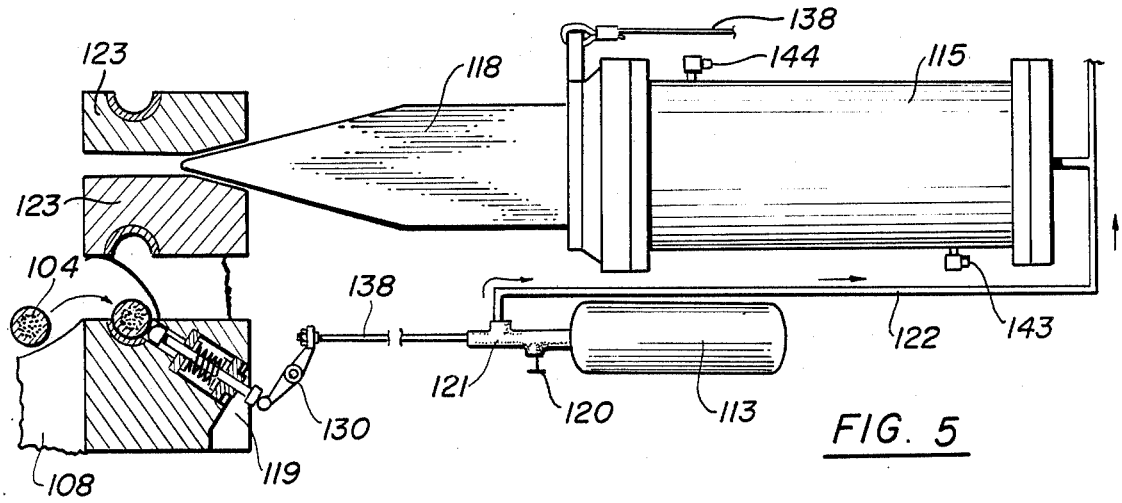
FIG. 5 is a sectional view taken on the line V—V of FIG. 4 with a side view of the centrally located wedge/block, cylinder and a liquid gas steel bottle.

In FIG. 5 the cable 104 is shown entering the stationary clamp 108, where the pressure exerted by the cable 104 as a result of the forward movement of the towed CCC&C depresses a spring loaded triggering assembly 119.

The mechanism is mounted within each stationary clamp 108 of which there are two. When the triggering assembly 119 is depressed by the cable 104, liquid gas is released from a steel liquid gas bottle 113, provided with a shut-off valve 120, a quick-release valve 121, and steel tubing 122 through which the liquid gas passes into the wedge/block gas cylinder 115. A piston within the cylinder is forced forward by the gas pressure, driving the wedge/block 118 forward. Two floating clamps 123 are held tightly in place above and below the wedge of the wedge/block 118 by two springs 116 as shown in FIG. 3.

When the wedge/block 118 is driven forward it forcefully separates the floating clamps 123 in opposite directions toward and against a stationary clamp 108, the lower one of which contains the cable 104, since it is the one on the bottom closest to the ocean floor.

At its full forward stroke the block portion of the wedge/block 118, is firmly placed between the separated and extended floating clamps 123. The cable 104 is now clamped.

Once the cable 104 is firmly clamped an electronic signal of a particular frequency and duration is transmitted to the tow vessel to indicate that the cable 104 has been caught and clamped. Electronic equipment is stored in a watertight compartment 117 at the rear of the CCC&C. The cable 104 can them be brought to the surface intact.

If it is desired to cut one side of the cable 104, clamp and retrieve the other, only one of two liquid gas bottles 113 located at the rear of the CCC&C as shown in FIG. 3 and FIG. 4, (which are used to actuate the hydraulic oil/gas cylinder 114 and the hydraulic knife cylinder 110 and its knife 111) is opened prior to submergence using the shut-off valve 120 shown in FIG. 10.

Figure 6:
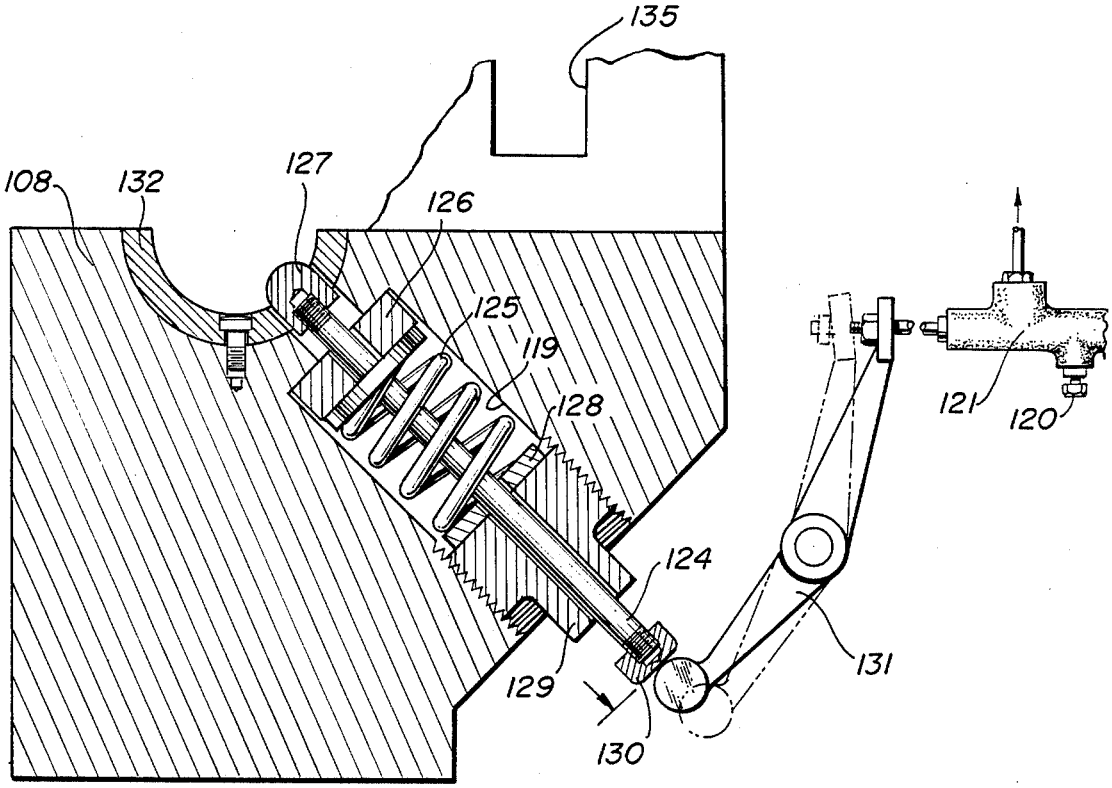
FIG. 6 is an enlarged segmental section from FIG. 5.

FIG. 6 represents an enlarged segmental section of FIG. 5. The spring loaded trigger assembly 119 is housed within each of two stationary clamps 108. The assembly 119 consists of a stem with collar 124, spring 125, bushing spacer 126, cable contact cap 127, spring washer 128, adjusting nut 129, lever contact cap 130 and actuating lever 131. Where the cable contact cap 127 protrudes, clamp inserts 132 of various inside diameters may be screwed into place in order to accommodate cables 104 of differing diameters.

Referring to FIG. 5, cable 104 has entered the stationary clamp 108. As detailed in FIG. 6, the cable 104 comes into contact with the cable contact cap 127. Pressure is exerted against the cable contact cap 127 by the cable 104 as a result of the forward movement of the CCC&C. The stem with collar 124 is moved downward against the spring 125, which rests against a spring washer 128 and adjusting nut 129, used to vary spring 125 tension.

The bushing/spacer 126 may be of various thicknesses which will determine the extension of the cable contact cap 127 into the clamping area of the stationary clamp 108. A lever contact cap 130 moves against the actuating lever 131 rotating it so as to open the quick-release valve 121 on the liquid gas bottle 113 as shown in FIG. 5. The released liquid going through the steel tubing 122, enters the wedge/block gas cylinder 115, where the liquid expanding into its gaseous state exerts pressure on the piston driving the wed/block 118 forward between the floating clamps 123, thus clamping the cable 104 firmly in place.

Figure 7:
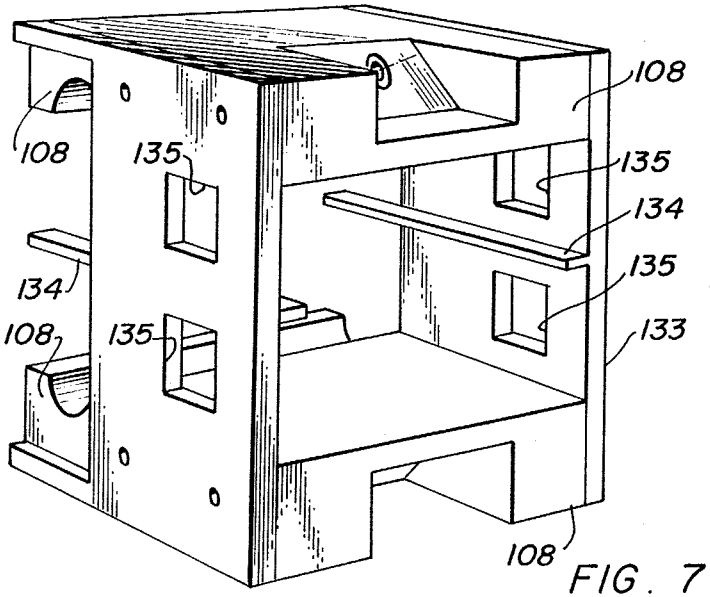
FIG. 7 is a perspective view of the floating and stationary clamps housing.

FIG. 7 is a perspective view of the floating and stationary clamps housing 133, consisting of stationary clamps 108, spacers 134 and spring tab slots 135.

Figure 8:
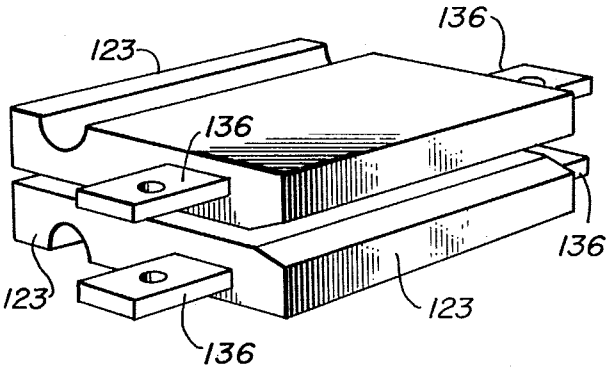
FIG. 8 is a perspective view of the floating clamps.

FIG. 8 is a perspective view of the floating clamps 123 with spring tabs 136.

Figure 9:
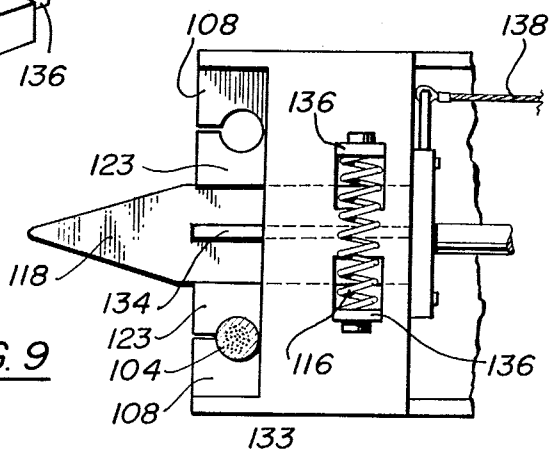
FIG. 9 is a side view of the clamps, wedge and housing assembly.

FIG. 9 is a side view showing the wedge/block 118 in the forward position with the floating clamps 123 and the stationary clamps 108, firmly locking the cable 104 in place. The floating clamp springs (one not shown) 116 attached to the spring tabs 136, are fully extended. All are assembled within the floating and stationary clamps housing 133.

FIG. 10 is a sectional detail X—X as shown in FIG. 4 of the hydraulic oil/gas cylinder 114, showing the internal piston 137.

If it is desired to cut one side of the cable 104 after it is clamped, the stop valve 120 of one of the two liquid gas bottles 113 is opened (the other kept closed) prior to submergence, depending on which side of the CCC&C the cable 104 is to be cut and the other side brought to the surface.

When the wedge/block 118 as shown in FIG. 9 is at its full stroke forward and the cable 104 firmly clamped, a gas release wire 138 opens two quick-release valves 121, one of which is shown in FIG. 10. Released liquid gas from a pre selected liquid gas bottle 113 is released to the hydraulic oil/gas cylinder 114 (one of two) where increasing gas pressure forces the internal piston 137 forward, displacing hydraulic fluid 139 through a hydraulic line 112.

FIG. 11 is a perspective view of one pair of diagonally opposed hydraulic knife cylinders 110 and a phantom view of the other pair. The hydraulic fluid 139 moving through the hydraulic line 112 goes into two of the hydraulic knife cylinders 110.

FIG. 12 is a sectional detail XII—XII as shown in FIG. 4 of a hydraulic knife cylinder 110. The hydraulic fluid 139 forces the piston 140, piston rod 141 and the attached knife 111, forward along a guide rail 142. The knife 111 at its full stroke will cut the clamped cable 104. At this point a second electronic signal is transmitted indicating that the cable 104 has been cut on a selected side and that the captured portion can be raised to the surface.

The hydraulic knife cylinder 110 is equipped with a charging valve 143 and a relieving valve 144.

Prior to submergence of the CCC&C a small amount of gas is injected into the cylinder 110 below the piston 140 through its charging valve 143. This small amount of gas and pressure acts against the bottom of the piston 140 holding it and the knife 111 in a retracted position. The gas pressure also acts to keep the outer face 145 and the knife base 146 pressed tightly together with a seal gasket 147 in between.

This design allows for a tight seal as the CCC&C goes deeper where the ocean pressure increases. When the hydraulic fluid 139 pushes the piston 140, rod 141 and knife 111 forward, pressure exerted under the piston prevents sea water from passing by the rod 141 and entering the hydraulic knife cylinder 110. A stuffing box 148 in the outer face 145 of the hydraulic knife cylinder consists of rod packing 149 and a threaded packing nut 150. This is for the purpose of sealing the rod 141 when it is extended.

As the piston 140 reaches the length of its stroke, pressure beneath the piston 140 prevents sea water from entering by the rod 141 and through the packing 149. The piston 140 continues moving and excess pressure is relieved through a pre set relieving valve 144, having its outlet port 151 at the bottom of the cylinder 110. The piston 140 covers and closes this outlet port 151 at the end of its stroke assuring continued watertight integrity.

All of the four hydraulic knife cylinders 110 are similarly designed and equipped.

The wedge/block gas cylinder 115, as shown in FIG. 5 also has the charging valve 143 and relieving valve 144. Not visible within the wedge/block gas cylinder 115 are a stuffing box 148, rod packing 149, packing nut 150 and a seal gasket 147 all similar to those shown in the hydraulic oil knife cylinder 110, FIG. 12.

All construction is sturdy enough to withstand deep sea pressures. Maximum steel thicknesses and welding is used where required. Steel pipe, tubing, valves and fittings, all of high pressure, are used throughout.

A mobile carrier will support the CCC&C at each end so that either scoop 101 or covers 106 can be removed for accessability to all parts. Once recovery is made removal of the cable 104, covers 106, replacement of empty liquid gas bottles 113, readjustment of the wedge/block 118 and knives 111 to normal positions, will take less than one hour.

What is claimed is:

1. I claim a communication cable grapple having the ability to ensnare a submarine cable from the ocean bottom after it is guided into a stationary clamp wherein the cable pressure applied by the forward movement of the towed grapple on the ocean bottom actuates a spring-loaded trigger within a stationary clamp, triggering the release of liquid/gas to a gas cylinder and piston of watertight integrity driving forward in one stroke a wedge/block between floating clamps in an appropriate housing and securely clamping the cable between the stationary clamp and the floating clamp closest to the ocean bottom, said clamps having interchangeable inserts to accommodate any diameter communication cable at which time the grapple may be raised to the surface intact or may be cut if preset to do so, on the desired side of the grapple utilizing one of a pair of hydraulic oil/gas cylinders, where released liquid/gas pressure actuates a floating piston wherein hydraulic oil is pressurized to only one pair (of two) diagonally opposed knife cylinders, wherein the hydraulic fluid under extreme pressure acts against the pistons, rods and knives, moving them one full stroke, cutting the firmly-clamped cable on the preselected side of the grapple so that the clamped portion of the submarine cable can be raised to the surface.

* * * * *